United States Patent [19]

Lygas

[11] Patent Number: 4,636,999

[45] Date of Patent: Jan. 13, 1987

[54] MAGNETOSTRICTIVE PULSE GENERATOR

[75] Inventor: Edward A. Lygas, Houston, Tex.

[73] Assignee: NL Industries, Inc., New York, N.Y.

[21] Appl. No.: 509,566

[22] Filed: Jun. 30, 1983

[51] Int. Cl.[4] ..... H04R 15/00

[52] U.S. Cl. ..... 367/156; 367/168; 310/26

[58] Field of Search ..... 175/40, 50; 181/102, 181/106; 367/25, 35, 86, 93, 140, 142, 156, 168, 911, 912; 310/26

[56] References Cited

U.S. PATENT DOCUMENTS

| | | | |
|---|---|---|---|
| 2,846,563 | 8/1958 | Cronin | 367/168 |
| 3,186,223 | 6/1965 | Wilson | 181/102 |
| 3,734,233 | 5/1973 | Wiley | 367/25 |

*Primary Examiner*—Salvatore Cangialosi
*Assistant Examiner*—Ian J. Lobo
*Attorney, Agent, or Firm*—Carl O. McClenny; William E. Johnson, Jr.

[57] ABSTRACT

A magnetostrictive generator includes a magnetostrictive transducer having a vanadium permandur core and series connected primary and secondary windings, the secondary winding having more turns that the primary winding. A commutating capacitor is connected in parallel with the primary and secondary windings of the transducer and a switch is connected in series with the primary winding. A storage capacitor, which is connected in parallel with the switch and the primary winding of the inductive transducer, is charged by a remotely located low voltage power supply when the switch is open. When the switch is closed, the storage capacitor discharges through the primary winding of the transducer to charge the commutating capacitor until the transducer reaches saturation, the commutating capacitor discharging thereupon to drive the transducer into hard saturation to produce magnetostrictive action in the core and physically deform the transducer and produce an acoustic signal.

14 Claims, 5 Drawing Figures

MAGNETOSTRICTIVE PULSE GENERATOR

BACKGROUND OF THE INVENTION

1. Field of the invention

This invention relates to acoustic pulse generators and more particularly, to a magnetostrictive acoustic pulse generator of the type which can be used at remote or inaccessible locations and which does not require a special high voltage power supply.

2. Description of the Prior Art

Acoustic pulse generators have widespread applications and may be used, for example, in generating sonar pulses for navigation and other submarine applications as well as in well drilling applications such as acoustic formation logging equipment and systems for monitoring the formation ahead of the bit during drilling operations. Although the acoustic pulse generator of the present invention is described in conjunction with drilling apparatuses in a downhole environment, it will be appreciated that the invention is not intended to be limited thereto, as will become apparent.

In downhole logging instrumentation an acoustic pulse generator is used to produce signals of an acoustic frequency adjacent the walls of the borehole at selected intervals to ensonicify and penetrate the walls of the borehole and enable the analysis of the sub-terranian formations through which the borehold passes. Logging systems which are used after a well is completed conventionally employ a wireline cable to supply electrical power from the surface for operation of the necessary circuitry and equipment located downhole. However, in such systems which are used to perform logging or other measuring operations during the process of drilling, electrical power must be obtained from sources located downhole and derived from means such as batteries and mud turbine generators which are incorporated as part of the drill string itself.

One type of acoustic pulse generator employs a piezoelectric crystal to produce mechanical pulses in a fluid medium in response to electical signals. Such devices, however, require very high voltage electrical driving signals, often on the order of 2000 to 3000 volts, in order to produce acoustic pulses of usable strength. Providing such high voltage in a borehole at a location several thousand feet below the surface is both a difficult and expensive undertaking which renders the use of piezoelectric transducers in measuring while drilling systems highly difficult.

Another type of acoustic pulse generator employs a magnetostrictive metal material as a core. Electrical signals are used to produce high levels of electromagnetic flux in the core which, in turn, produce a physical deformation of the core due to magnetostrictive action. This physical deformation is employed to produce an acoustic pulse in the fluid medium within which the core is located. One problem associated with magnetostrictive pulse generators is that in order to produce a sufficient magnetic flux level in the transformer core for magnetostrictive effects to occur, very high magnetic field intensities are required. Again, in a system for measuring while drilling in a borehole environment the provision of downhole power supplies having high current capabilities regardless of whether batteries or mud turbine generators are used, are very expensive to both implement and operate.

The magnetostrictive pulse generator of the present invention overcomes the disadvantages of the prior art by generating he magnetic field intensities necessary for magnetostrictive effects within its own circuitry from power sources of conventional capacity.

BRIEF DESCRIPTION OF THE INVENTION

In view of the above, it is, therefore, an object of the invention to provide an improved acoustic pulse generator circuit.

It is another object of the invention to provide an acoustic pulse generator of the type described in which relatively high voltages and currents are not required to be supplied locally for the operation of the circuit.

It is another object of the invention to provide an acoustic pulse generator circuit of the type described in which high voltage switches, such as transistors, silicon control rectifiers and thyratrons need not be used.

It is still another object of the invention to provide an acoustic pulse generator of the type described in which the circuit is efficient and the power requirements and temperature rise with operation are minimal.

It is still another object of the invention to provide an acoustic pulse generator of the type described in which the pressure waveform produced is of Gaussian form and is relatively free of ringing.

Further, an acoustic generator in accordance with a broad aspect of the invention comprises an inductive transducer including a core, formed of highly magnetostrictive material such as vanadium permandur, and series connected primary and secondary windings, the secondary winding having more turns than the primary winding. A commutating and driving capacitor is connected in parallel with the primary and secondary windings of the transducer and a switch is connected in series with the primary windings. A storage capacitor, connected in parallel with the switch and the primary winding of the magnetostrictive transducer, is charged by a remotely located low voltage, low capacity power supply when the switch is open. When the switch is closed, the storage capacitor discharges through the primary winding of the transducer to charge the commutating capacitor until the transducer core reaches saturation, the commutating capacitor discharging thereupon to drive the inductive transducer further into saturation to physically deform the transducer and produce an acoustic signal.

BRIEF DESCRIPTION OF THE DRAWING

Other features and intended advantages of the invention will be more readily apparent by reference to the following detailed description in connection with the accompanying drawings wherein.

While the invention will be described in connection with a presently preferred embodiment, it will be understood that it is not intended to limit the invention to the embodiment. On the contrary, it is intended to cover all alternatives, modifications and equivalents as may be included within the spirit of the invention as defined in the appended claims.

DETAILED DESCRIPTION OF THE PREFERRED EMBODIMENT

Figure 1:
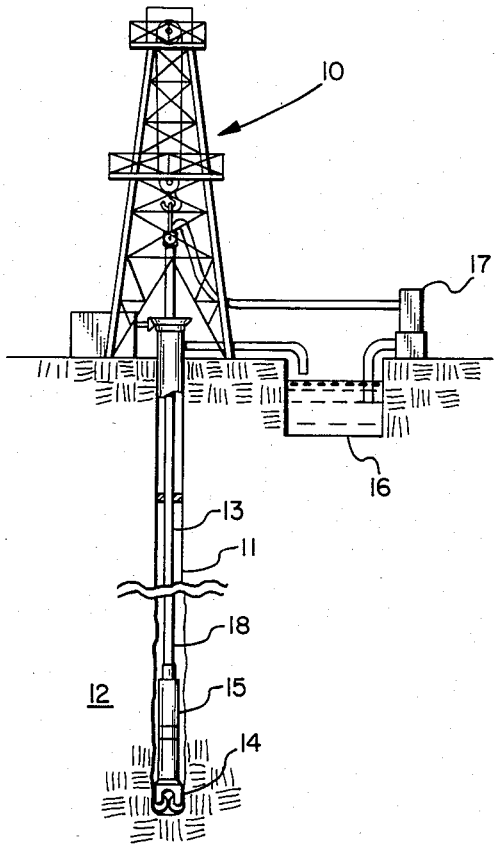
FIG. 1 is a diagrammatic view, in cross-section, of a drilling apparatus including a downhole acoustic logging system with which a pulse generator constructed in accordance with the present invention may be used.

The present disclosure is made with reference to the drilling art, in which an acoustic generator in accordance with the invention is associated in a downhole instrumentation. There is shown in FIG. 1 an illustration of a drilling rig 10 in the process of drilling a borehole 11 into formations 12 in the earth. The drilling rig includes a drill string 13 having affixed to the lower end thereof a drilling bit 14 and a data handling sub 15 which can measure various parameters such as weight on bit, drill torque, and formation ahead of bit in the downhole environment during the drilling operation.

The drill string 13 includes a plurality of sections of drill pipe joined longitudinally and which have a central tubular passageway for the flow of drilling muds taken from a mud pit 16 by a mud pump 17 and pumped under pressure down the central opening in the drill stem to exit from apertures formed near the drill bit 14. The mud is used for numerous functions including cooling and lubricating the drill bit 14 and removing formation cuttings by passage of the mud back to the surface through the annular space 28 between the drill stem and the walls of the borehole 11. The returning mud flow exits from the borehole annulus through a mud return pipe into the mud pit 16. The magnetostrictive pulse generator of the present invention may be used in a system for monitoring the formation ahead of the bit and mounted in the sub 15.

Figure 2:
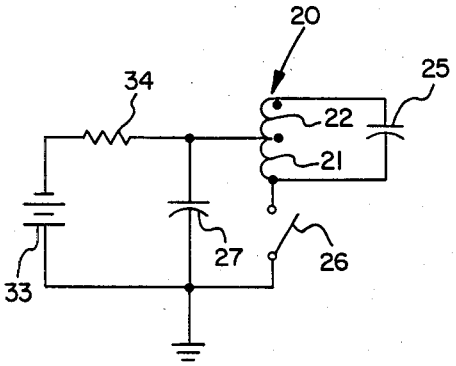
FIG. 2 is a schematic diagram of a pulse generator constructed in accordance with a broad aspect of a preferred embodiment of the invention.

A schematic diagram of a circuit constructed in accordance with a broad aspect of the invention, is shown in FIG. 2, and includes an autotransformer 20 having a primary winding 21 connected in a series with a secondary winding 22 about a core (not shown) formed of a material having highly magnetostrictive properties. A capacitor 25, is connected in parallel with the primary and secondary windings 21 and 22 of the transformer 20. A switch 26 is connected in series with the primary winding 21 of the transformer 20, and a storage capacitor 27 connected in parallel with switch 26 and the primary winding 21 of the transformer 20. A primary voltage supply such as a battery 33 is connected in parallel with the storage capacitor 27 and a series limiting resistor 34. The series limiting resistor 34 is connected between the battery and the capacitor 27 to limit the charging current delivered to the storage capacitor 27 from the battery 33.

In operation, briefly, when the circuitry of FIG. 2 is at rest with the switch 26, open, the battery 33 charges the storage capacitor 27 through the limiting resistor 34 until a fully charged condition is esablished on the storage capacitor 27. When the switch 26 is closed, the storage capacitor 27 discharges through the primary winding 21 of the transformer 20. Since the primary and secondary are wound on a common core, the voltage produced in the primary winding 21 of the transformer 20 produces a voltage across the secondary winding 22 of the transformer 20 and the combination of voltages across the windings 21 and 22 is applied to charge the commutating capacitor 25. During most of the time that the commutating capacitor 25 is being charged, the core of the transformer 20 is in an unsaturated state so that it has a relatively high inductance and, therefore, the current flowing in the loop comprising the primary and secondary windings 21 and 22 of the transformer 20 and the commutating capacitor 25 is relatively low. As the charge upon the commutating capacitor 25 increases to a sizable value, the core of the transformer 20 saturates and the inductance decreases to a lower value at which it can no longer support the high voltages across the capacitor. Discharge of the energy stored in the commutating capacitor 25 through windings 21 and 22 causes an extremely large current to flow in both the primary and secondary windings 21 and 22 of the transformer 20 driving the core further into saturation. The secondary winding 22 is formed of a much larger number of turns than the primary winding 21 and is connected so that the flux is additive when the commutating capacitor is discharging. Thus, the large current flow back through winding 22 further increases the magnetic field intensity in the core. At this point, the switch 26 is opened in response to the high current level and the circuit is allowed to ring down until the circuit energy is dissipated. The very large magnetic field intensity causes deformation of the highly magnetostrictive core of the transformer 20, which supersaturates the core thereby producing a large amplitude acoustic signal, the frequency of which is determined by the particular mechanical configuration of the core and windings of the transformer 20.

Figure 4:
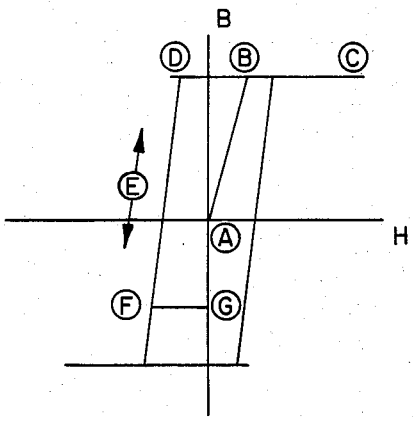
FIG. 4 is a graph of a hysteresis curve generated in the operation of the circuit in FIG. 2.

The operation of the circuit of FIG. 2 can be further appreciated from inspection of the BH curve shown in FIG. 4. Initially, the circuit begins operation around the origin of the BH on the B axis curve at point "A". When the switch 26 is closed and the capacitor 27 begins to discharge through the primary winding 21 of the transformer 20, the magnetic field intensity linearly increases until the transformer core reaches saturation at point "B". Once the core of the transformer 20 reaches saturation, and the commutating capacitor 25 begins discharging because the core inductance of the transformer will no longer support the high voltage across the capacitor, the current sharply increases to thereby drive the core of the transformer 20 into hard saturation as illustrated at point "C" of the BH curve. Before reaching point "C", the switch 26 is opened. It is at point "C" of the saturation of the core that its magnetostriction or deformation is greatest. The acoustic pulse is generated by the compression of the fluid created by the deformation of the core. As the circuit energy dissipates its inductance switches to the high state at point D. By now the current flow has started in the opposite direction. The core's BH values follow the core material BH curve to point "E" somewhere on the curve. Because of the current reversal, the commutating capacitor has charged partially at point "F" at which the current has peaked. The circuit again establishes its neutral or at rest position, the "B" field is reduced so that the circuit comes to rest on the BH curve at point "G" which will lie somewhere on the B axis. Thereafter the processes are again repeated. The point on the vertical axis of the BH curve at which the transformer comes to rest is a function of the supply voltage, the time it takes to reach saturation from the rest position on the BH curve and the reset time. It should be noted that the BH curve which is generated is of a square loop configuration; that is, the BH curve has an essentially parallelogram configuration with flat upper and lower extremes and steeply rising sides. This is referred to herein as a "square loop" property.

It has been found in the construction of the transformer 20 that the fabrication of the transformer about a rolled cylindrical core of annealed vanadium permandur is particularly well suited to provide the high magnetostriction or deformation required.

Figure 3:
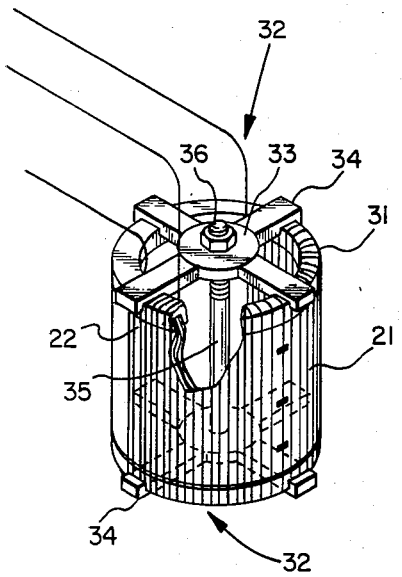
FIG. 3 is a schematic perspective view of a magnetostrictive transformer used in generating an acoustic pulse, in accordance with the invention.

As shown in FIG. 3, a suitable transformer 20, may comprise a core formed by rolling a long narrow strip of magnetostrictive material into a cylinder and tack welding the ends to prevent unravelling. The core is wound with a small number of turns to form primary winding 21 and then with a much larger number of turns to form secondary 22. A protective coating of silicone rubber 31 is applied to the ends of the core over which windings 21 and 22 are formed. Movement of the core in the axial direction is held by a fixture comprising support brackets 32 located at either end of the core. Each bracket 32 consists of a hub 33 having a central aperture and four radially extending arms 34 which overlie the silicone rubber covered ends of the core. A tension rod 35 extends along the axis of the core and has opposing threaded ends which pass through the openings in the central hubs 33 of the brackets 32. Nuts 36 are received onto the threaded ends of the rods 35. The nuts 36 are tightened to pull the brackets 32 toward one another to hold the core so that the magnetostrictive movement of the core in the radially outward direction for generation of an acoustic pulse in the surrounding fluid medium is not impaired.

The material from which the core is formed preferably has a high magnetostrictive coefficient which produces a high inductance prior to saturation and a relatively lower inductance after saturation with a sharp boundary therebetween. Although certain high nickel content materials can be used, the preferred material is vanadium permandur which has been annealed with the proper selection of temperature and cooling rates and environment to maximize favorable magnetostrictive and square loop properties. In one embodiment a transformer core approximately two inches was formed of material 2 mils thick and then wrapped with a primary winding of 8 turns and a secondary winding of 83 turns to produce acoustic pulses having a high-quality, half-cycle sinusoid waveform.

Figure 5:
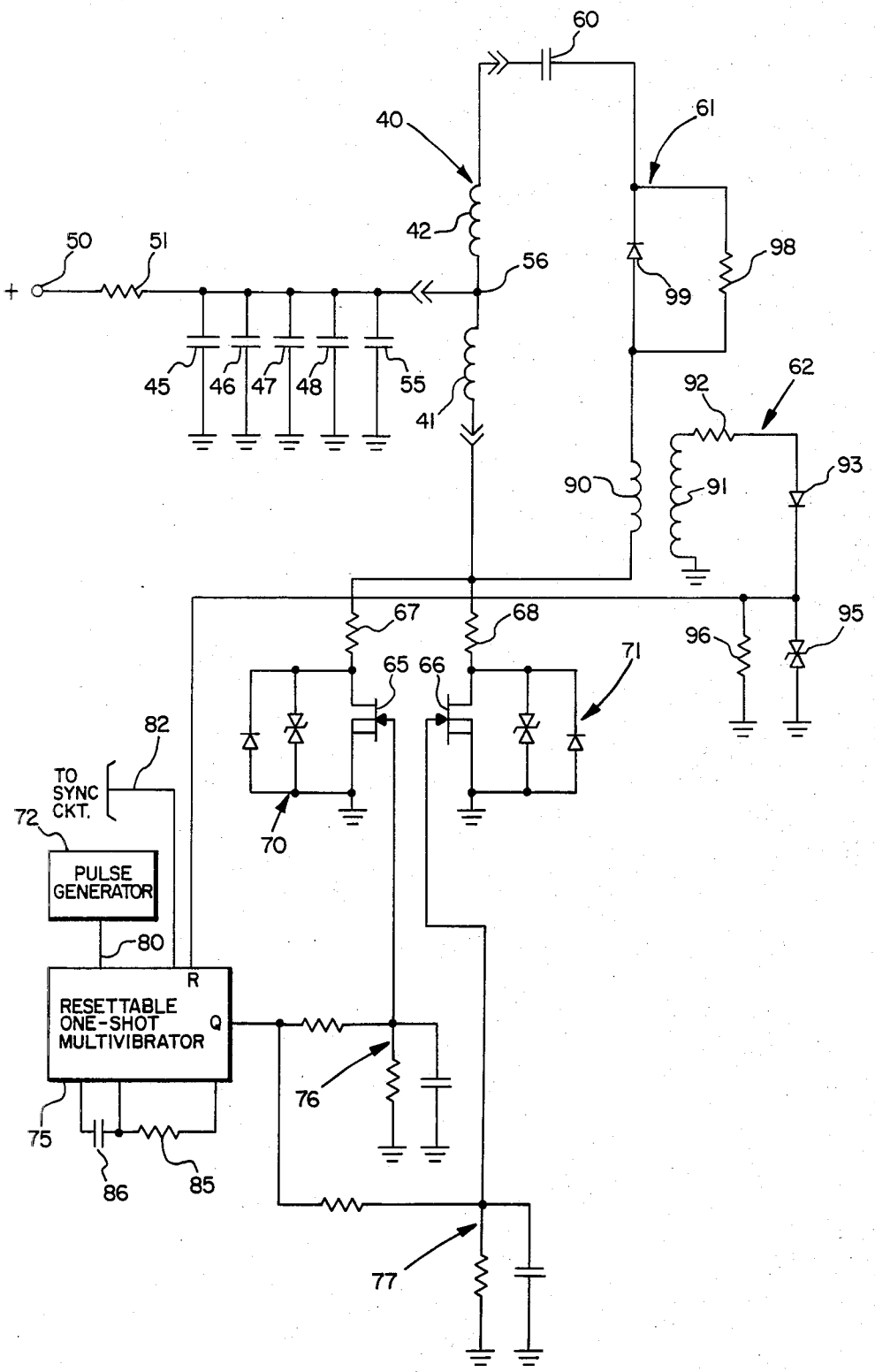
FIG. 5 is a schematic diagram illustrating the details of a preferred circuit for use in the acoustic pulse generator constructed in accordance with the invention.

One circuit which can be used to effect acoustic pulses in accordance with the preferred embodiment of the invention is shown in FIG. 5 in schematic diagram form. As shown, the transformer 40 includes a primary winding 41 and a secondary winding 42. The primary and secondary windings 41 and 42 are formed about a core of the type shown and discussed in connection with FIG. 3 of generally cylindrical shape and formed of a sheet of material of high magnetostrictive coefficient, such as vanadium permandur rolled into a cylinder. The primary and secondary windings are formed about the core with the primary having between seven to nine windings and a secondary having between about eighty-three to a hundred-fifty windings.

As shown, a plurality of capacitors 45, 46, 47 and 48 are connected in parallel between a positive supply voltage 50 and ground. The several smaller capacitors 45–48 are used in lieu of a single large capacitor to store energy so that a power supply of a low current capacity rating may be used for the supply voltage 50. The supply voltage 50 may be on the order of about 20 to 60 volts. A current limiting resistor 51 is provided through which the capacitors 45–48 are charged. A fifth capacitor 55 is provided, the capacitor 55 being a relatively small value to shunt to ground any high frequency resonation currents which may exist at the interconnection 56 between the primary and secondary windings 41 and 42 of the transformer 40.

A commutating capacitor 60 is provided in parallel with the primary and secondary windings 41 and 42 of the transformer 40 and in series with a damping and stabilizing circuit 61 and a saturation current sensing circuit 62, described below. It has been found that the commutating capacitor 60 should be fairly large, for instance, on the order of about 0.22 Microfarads. With the circuit thus formed, it has been found that the mechanical resonant frequency of the transformer 40 can be on the order of 17 KHz, a desirable mechanical acoustic frequenccy in acoustic downhole logging systems. It should be noted that by varying the dimensions and thicknesses of the laminations of the core of the transformer 40, various other mechanical or acoustic frequencies can be achieved, as will be apparent to those skilled in the art. The number of windings and the size of the capacitor can be adjusted to tune the electrical excitation to the mechanial profiles of the core, thereby enabling efficient performance of the circuit over a range of acoustic frequencies from 5 KHz to 200 KHz.

The switch function in the cicuit of FIG. 5 is performed by two field effect transistors 65 and 66 which are connected with their respective sources and drains connected in series with the primary and secondary windings 41 and 42 of the transformer 40 and ground. Resistors 67 and 68 are connected in series with the respective sources of FETs 65 and 66 to limit the respective FET currents, and transient or switching voltage protection is provided for the respective FETS 65 and 66 by diode networks 70 and 71, respectively. As mentioned, the resistors 67 and 68 limit potentially destructive high currents which may exist before the reset function of the circuit is actuated, as described below.

A resettable one-shot multivibrator 75 is provided to produce on its output line Q a signal to the respective gates of the FETs 65 and 66. The output signal on line Q from the one-shot 75 is applied via respective resistor and capacitor networks 76 and 77 which isolates the one-shot 75 from the currents existing in the remainder of the circuit.

The one-shot 75 is triggered from a signal on line 80 which is connected to a variable pulse generator 72. The one-shot also provides a confirmation signal on line 82 for use in indicating the firing of the one-shot for timing of acoustic pulse generation with receiving circuitry or other coordination purposes. The uninterrupted width of the pulse generated by the one-shot 75 is adjusted to be on the order of 200 to 300 milliseconds by the network of resistor 85 and capacitor 86 in the manner known in the art. It should be noted that the one-shot 75 can comprise an integrated circuit type 4047, widely available from semiconductor and integrated circuit distribution concerns.

As mentioned, a saturation current sensing circuit 62 is provided in the saturation loop of the transformer 40. A primary winding 90 of a sensing transformer is connected in series with the transformer 40 and commutating capacitor 60, to sense the current flowing in the loop. The secondary winding 91 of the sensing transformer 90 is connected between ground and a diode 93 through a series resistor 92. A double-back zener diode transient suppressor 95 is connected in parallel with a resistor 96 from the cathode of the diode 93 to ground to condition the signal developed by the circuit 62 for application to a reset terminal R of the one-shot 75. Thus, the saturation current sensing circuit 62 operates to detect when the current within the saturation loop comprising the transformer 40 and commutating capacitor 60 reaches a predefined current level, at which time it develops a reset signal to the R terminal of the one-shot 75 discontinuing the output on the Q terminal thereof to open the switch defined by the FETs 65, 66 and their respective components. In addition, in order to provide stable operation, a resistor 98 and diode 99 connected in parallel are connected in series with the transformer 40 and commutating capacitor 60. The resistor 98 and diode 99 serve to damp oscillaions and establish a stable core rest position on the BH cure. Thus, with reference once again to FIG. 4, the point "G" represents a rest position which would be established after each discharge/saturation cycle of the transformer 40 and capacitor 60.

In the operation of the circuitry of FIG. 5 the capacitors 45–48 are charged to the supply voltage 50 through resistor 51 during the quiescent stae of the circuit. A pulse from the pulse generator 72 overline 80 triggers operation of the one-shot multivibrator 75. A pulse on the Q lead of the one-shot 75 is applied to the gates of the two FETs 65 and 66 to establish current flow between the source and drain terminals thereof. The FETs turn on hard and enable current flow from the storage capacitors 45–48 through the primary winding 41 of the autotransformer 40 and the current limiting resistors 67 and 68. As the current starts to build through winding 42 autotransformer action takes place in the core of transformer 40 and the commutating capacitor 60 begins to charge. The flux density and magnetizing force in the core of the transformer move from point "G" toward saturation at a point between "B" and "C" of FIG. 4. Once the core reaches this saturation point, the commutating capacitor 60 is charged to its maximum value, which is determined by the value of the supply voltage, the time it takes to reach saturation from the rest position on the BH curve and the number of turns on the primary winding 41. Significant magnetostrictive action starts to occur in the core at this point. The inductance of the transformer switches from a high to a very low value and the core can no longer support the high voltage to which the commutating capacitor 60 has been charged. The capacitor starts to discharge and produces current flow through the entire combined number of turns or both the primary winding 41 and the secondary winding 42. It is important to note that the core was initially saturated by current flow through only the primary winding of, for example 8 turns. However, after saturation and the commutating capacitor 60 starts to discharge from a high voltage, the current flow is through both windings of the autotransformer which may be, for example, about 91–160 turns to develop a large number of ampere turns, which drives the core extremely hard into super-saturation at point "C" on th curve of FIG. 4. For example, flux densities on the order of 300 to 400 oersteds may be developed in the core which produces a tremendous amount of magnetostrictive action which results in a very strong acoustic pulse.

As the commutating capacitor 60 discharges and causes current to flow in the opposite direction along path "B"- "C" of FIG. 4, the primary winding 90 of the sensing transformer detects the current and produces an output signal on the secondary winding 91. The pulse on the winding 91 is fed through resistor, 92 and is conditioned by diodes 93 and the transient suppressor 95 and resistor 96 in parallel to be applied to the reset lead "R" of the one-shot 75. The reset pulse to the one-shot terminates its output on the "Q" lead and removes the drive to the gates of the FETs to open the source drain path and allow the LC circuit to ring back to quiescence over the path "D"- "E"- "F"- "G" of FIG. 4. Therefore, the storage capacitors 45–48 are recharged to the supply voltage 50 through resistor 51 and the circuit is ready for another cycle.

In one embodiment 17 KHz acoustic pulses are generated at a 200 millisecond repetition rate which serves well for an acoustic logging system.

The invention is also intended for use in numerous applications in which a high resolution acoustic waveform is needed, for example, in cement bonding tools to resolve the bond between well casing and the surrounding cement, in downhole well logging equipment, in uses as a "pinger" which acoustically marks underwater objects upon which submarine acoustic navigation and positioning systems can reference, in use as bathymetric or sub-bottom profile measuring equipment, in high resolution mine hunting sonar applications in which the lower frequency would provide greater detection ranges and penetration depths and for various uses in medical electronic instrumentation.

The foregoing description of the invention has been directed primarily to a particular preferred embodiment in accordance with the requirements of the patent statutes and for purposes of explanation and illustration. It will be apparent, however, to those skilled in the art that many modifications and changes in the specifically described and illustrated apparatus and method may be made without departing from the scope and spirit of the invention. For example, while the disclosure of the system has been described primarily with regard to particular coil configurations, and specific frequencies, it may be appreciated from the present description and illustrations that other coil configurations, frequencies and the like could be used without departing from the present invention in its broadest aspects. Therefore, the invention is not restricted to the particular form of construction illustrated and described, but covers all modifications which may fall within the scope of the following claims.

It is Applicant's intention in the following claims to cover such modifications and variations as fall within the true spirit and scope of the invention.

What is claimed is:

1. An acoustic generator, comprising:

a magnetostrictive transducer including a core of magnetostrictive material, a first winding wound on said core, and a second winding on said core attached to and wound as the continuation of said first winding;

a switch in series with said first winding of said transducer;

a first capacitor in parallel with the series combination of said switch and said first winding of said transducer;

a second capacitor in parallel with said first and second windings of said transducer; and a power supply to charge said first capacitor when said switch is open;

whereby when said switch is closed, the charge on said first capacitor discharges through said first winding to induce a voltage in said scond winding which charges said second capacitor until said transducer reaches saturation, causing said second capacitor to discharge through said first and said second windings to drive said transducer further into saturation thereby causing said transducer to physically deform and produce an acoustic signal.

2. The acoustic generator of claim 1 further comprising a third capacitor, possessing superior high frequency characteristics, in parallel with said first capacitor for shunting transient signals.

3. The acoustic generator of claim 1 wherein said core of said transducer is vanadium permandur.

4. The acoustic generator of claim 1 further comprising a pulse generator to control said switch.

5. The acoustic generator of claim 4 wherein said switch comprises at least one semiconductor device controlled by said pulse generator.

6. The acoustic generator of claim 4 further comprising means for sensing the saturation current in said transducer for resetting the output of said pulse generator.

7. The acoustic generator of claims 4, 5 or 6 wherein said pulse generator is a one shot multivibrator.

8. The acoustic generator of claim 1 further comprising means connected to said transducer for dumping unwanted signal pulses.

9. The acoustic generator of claim 8 wherein said means for damping comprises a resistor in series with said secondary winding and said second capacitor.

10. The acoustic generator of claim 9 further comprising a diode connected across said resistor to enable said second capacitor discharge currents to flow unimpeded and to control said core remanance point.

11. An acoustic generator, comprising:

a magnetostrictive transducer including a vanadium permandur core, a first winding wound on said core and a second winding on said core attached and wound as the continuation of said first winding, said second winding having many more turns than said first winding;

a switch connected in series with said first winding;

a first capacitor connected in parallel with said first winding and said switch;

a second capacitor connected in parallel with said first and said second windings of said transducer; and a low voltage power supply to charge said first capacitor when said switch is open;

whereby when said switch is closed, said first capacitor discharges through said first winding to induce a voltage in said second winding to charge said second capacitor, until said transducer reaches saturation, said second capacitor discharging through said first and said second winding of said transducer thereupon to drive said transducer further into saturation to physically deform said transducer and produce an acoustic signal.

12. The acoustic generator of claim 11 wherein said core is of hollow, cylindrical shape formed of a sheet of rolled up vanadium permandur.

13. The acoustic generator of claim 12 wherein said transducer has a square loop BH property.

14. The acoustic generator of any of claims 11, 12 or 13 wherein the mechanical resonant frequency of said transducer is on the order of a range between 5 KHz and 200 KHz.

* * * * *